US007876184B2

(12) United States Patent
Mikl et al.

(10) Patent No.: US 7,876,184 B2
(45) Date of Patent: Jan. 25, 2011

(54) ELECTRICAL RELAY

(75) Inventors: Rudolf Mikl, Arbesthal (AT); Gerhard Stangl, Waidhofen (AT); Johann Loy, Kapellerfeld (AT)

(73) Assignee: Tyco Electronics Austria GmbH, Vienna (AT)

( * ) Notice: Subject to any disclaimer, the term of this patent is extended or adjusted under 35 U.S.C. 154(b) by 0 days.

(21) Appl. No.: 12/759,458

(22) Filed: Apr. 13, 2010

(65) Prior Publication Data

US 2010/0194502 A1 Aug. 5, 2010

Related U.S. Application Data

(63) Continuation of application No. 11/741,277, filed on Apr. 27, 2007, now abandoned.

(30) Foreign Application Priority Data

May 6, 2006 (DE) ..... 10 2006 021 203

(51) Int. Cl.
*H01H 67/02* (2006.01)
*H01H 51/22* (2006.01)

(52) U.S. Cl. ..... 335/126; 335/78; 335/115; 335/129

(58) Field of Classification Search ..... 335/7, 335/20, 57, 71, 151, 155, 196, 78–84, 115, 335/126, 129, 130
See application file for complete search history.

(56) References Cited

U.S. PATENT DOCUMENTS

| | | | |
|---|---|---|---|
| 5,289,144 | A | 2/1994 | Liao |
| 5,969,586 | A | 10/1999 | Noda et al. |
| 6,426,689 | B1 | 7/2002 | Nakagawa et al. |
| 6,496,090 | B1 | 12/2002 | Nishida et al. |
| 6,765,463 | B2 | 7/2004 | Mader et al. |
| 6,903,639 | B2 | 6/2005 | Sanada et al. |
| 2002/0024412 | A1 | 2/2002 | Wu |

(Continued)

FOREIGN PATENT DOCUMENTS

| | | | |
|---|---|---|---|
| DE | 3000681 | C2 | 8/1983 |

(Continued)

OTHER PUBLICATIONS

European Search Report for Application No. EP 00 9039 dated Jul. 18, 2007, 2 pages.

*Primary Examiner*—Anh T Mai
*Assistant Examiner*—Mohamad A Musleh
(74) *Attorney, Agent, or Firm*—Barley Snyder LLC

(57) ABSTRACT

An electrical relay includes a magnetic system, a contact system and a slider. The magnetic system includes an armature. The contact system includes a moveable spring contact and a fixed spring contact. The moveable spring contact is moveable between an open position and a closed position. The moveable spring contact is in electrical contact with the fixed spring contact in the closed position. The slider connects the moveable spring contact to the armature. The slider transfers movement of the armature to the moveable spring contact. The slider has at least one contact opening element extending there from. The contact opening element strikes the moveable spring contact during movement of the moveable spring contact to the open position to break any existing weld between the moveable spring contact and the fixed spring contact.

14 Claims, 12 Drawing Sheets

U.S. PATENT DOCUMENTS

| | | | |
|---|---|---|---|
| 2002/0175787 | A1 | 11/2002 | Mader et al. |
| 2005/0190026 | A1 | 9/2005 | Mikl |
| 2005/0242907 | A1 | 11/2005 | Minowa et al. |
| 2007/0257752 | A1 | 11/2007 | Mikl et al. |

FOREIGN PATENT DOCUMENTS

| | | | |
|---|---|---|---|
| DE | 9320696 | U1 | 1/1995 |
| DE | 19715261 | C1 | 12/1998 |
| DE | 19847831 | A1 | 8/2001 |
| EP | 0237610 | A2 | 9/1987 |
| EP | 0579832 | A1 | 1/1994 |
| EP | 1244127 | A1 | 4/2003 |
| EP | 10239284 | A2 | 4/2003 |
| EP | 1420429 | A1 | 5/2004 |

ELECTRICAL RELAY

CROSS-REFERENCE TO RELATED APPLICATIONS

This application is a continuation application of U.S. application Ser. No. 11/741,277, filed Apr. 27, 2007 now abandoned, which claims the benefit of German Patent Application No. DE 10 2006 021 203.7, filed May 6, 2006.

FIELD OF THE INVENTION

The invention relates to an electrical relay with a moveable spring contact connected to an armature via a slider that acts on the moveable spring contact.

BACKGROUND

An electrical relay provided with a slider that is arranged parallel to a base plane of the electrical relay is known, for example, from EP 1 244 127 A2. In this electrical relay, the slider is in the form of a substantially rectangular plate and transmits movement of an armature to a contact system of the electrical relay. The armature is arranged adjacent one end of the slider and the contact system is arranged adjacent an opposite end of the slider. The armature engages with a recess in the slider via an armature projection, so that movement of the armature is converted directly into horizontal movement of the slider.

In a monostable electrical relay, the contact system consists, for example, of a fixed spring contact and a moveable spring contact. When a magnetic system of the electrical relay is excited, the moveable spring contact is moved by the slider from an open position toward the fixed spring contact into a closed position, as a result of the armature being drawn toward a coil of the magnetic system. When the magnetic system of the electrical relay is unexcited, the position of the armature is restored thereby moving the slider such that the moveable spring contact is drawn away from the fixed spring contact and back into the open position. A restoring force inherent to the moveable spring contact causes it to rapidly return to the open position. However, if the moveable spring contact is welded to the fixed spring contact relatively frequently, when the slider returns the moveable spring contact to the open position, as a result of the force of the armature, the moveable spring contact remains welded to the fixed spring contact, so the functioning of the electrical relay is impaired.

Bistable electrical relays or magnetic systems comprising a substantially H-shaped armature are known, for example, from DE 197 15 261 C1 and DE 93 20 696 U1. In contrast to the monostable electrical relay, the bistable electrical relay alternates between two switching positions by reversing the polarity of a magnetic system. The magnetic system provides force for both switching directions, so force is applied to the moveable spring contact of the electrical relay not only on closing but also on opening. This is especially advantageous in relation to the tearing of welds occurring during the electrical service life of the electrical relay.

Additionally, it is known to fixedly enclose an end of a moveable spring contact that is remote from a base of the electrical relay in a slot in a slider in order to tear welds on opening. FIG. 1 shows an example of such an electrical relay according to the prior art. As shown in FIG. 1, the electrical relay comprises a slider 2 that is moved horizontal to a base plane 1 that is defined by a base plate of a base 4 of the electrical relay. An end of a moveable spring contact 3 that is remote from the base plane 1 is fixedly enclosed in a slotted recess 5 in a slider 2. In a monostable electrical relay, on welding, the restoring force of an armature 6 is applied to the moveable spring contact 3 once the magnetic system has been unexcited. As the armature 6 and the slider 2 are fixedly connected to the moveable spring contact 3, there is available for the purposes of opening the moveable spring contact 3 from a fixed spring contact 11, a uniform, relatively low restoring force which in many cases is insufficient to tear the weld and to open the moveable spring contact 3. This situation is also problematic in a bistable magnetic system, as the armature is fixed and does not enter a region in which a considerable opening force is applied, as is known, until an end of the armature movement.

BRIEF SUMMARY

It is an object of the present invention is to provide an electrical relay of the type mentioned at the outset wherein welds of a moveable spring contact to a fixed spring contact are torn on actuation of the electrical relay.

This and other objects are achieved by an electrical relay comprising a magnetic system, a contact system and a slider. The magnetic system includes an armature. The contact system includes a moveable spring contact and a fixed spring contact. The moveable spring contact is moveable between an open position and a closed position. The moveable spring contact is in electrical contact with the fixed spring contact in the closed position. The slider connects the moveable spring contact to the armature. The slider transfers movement of the armature to the moveable spring contact. The slider has at least one contact opening element extending there from. The contact opening element strikes the moveable spring contact during movement of the moveable spring contact to the open position to break any existing weld between the moveable spring contact and the fixed spring contact.

DETAILED DESCRIPTION OF THE EMBODIMENT(S)

Figure 1:
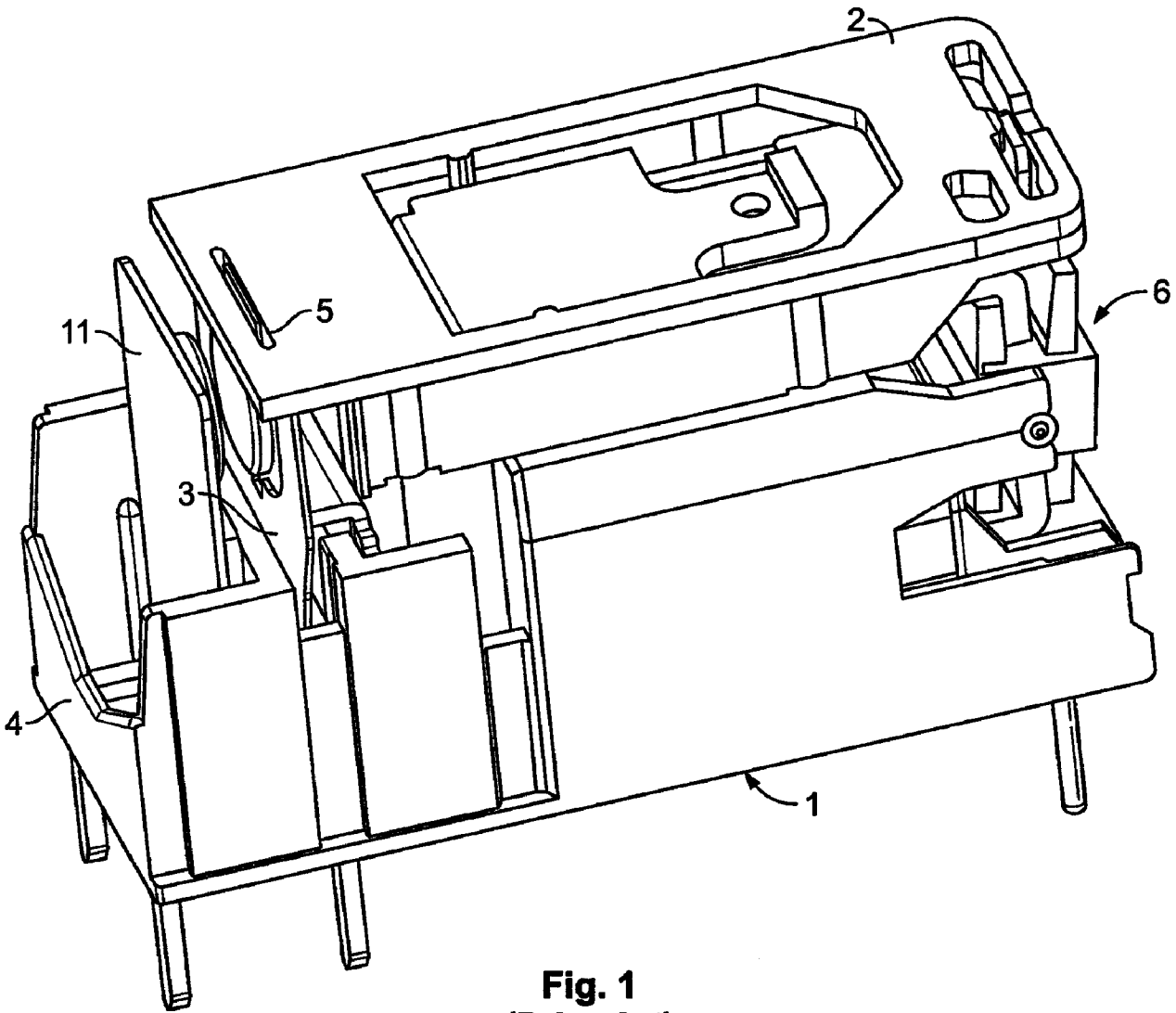
Fig. 1 (Prior Art)
FIG. 1 is a schematic perspective view of an electrical relay of the prior art.
Figure 2:
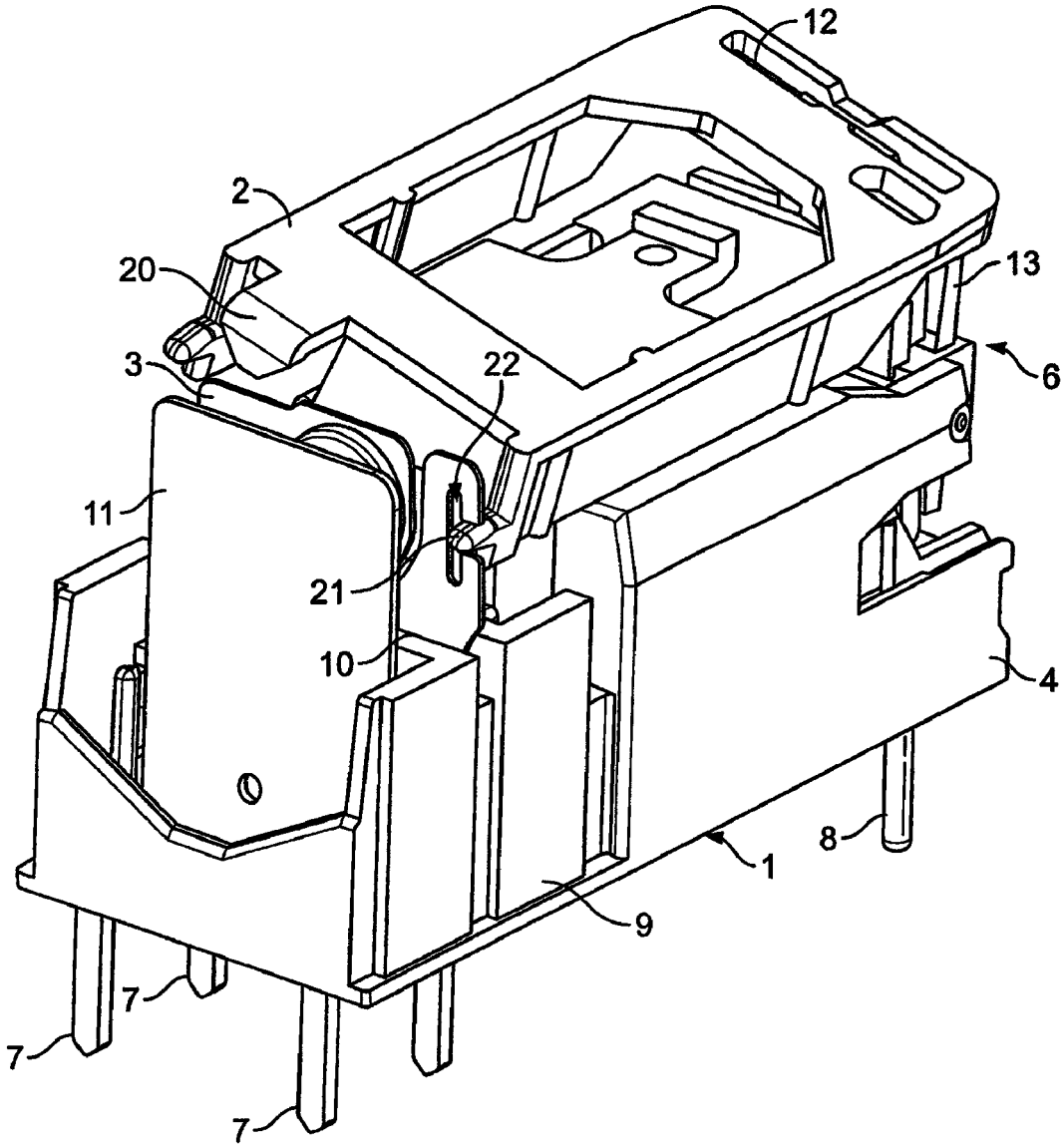
FIG. 2 is schematic perspective view of an electrical relay according to a first embodiment of the present invention.

FIG. 2 shows an electrical relay according to a first embodiment of the present invention. As shown in FIG. 2, the electrical relay is a bistable electrical relay comprising a substantially H-shaped armature 6. The electrical relay has a base 4 which is made of an insulating material. The base 4 has a substantially flat connection side and a base side that defines a base plane 1. Electrical terminals 7, 8 extend from the base side. The base 4 has a trough-like recess for receiving a magnetic system and a plurality of side walls 9 and transverse walls 10 that can be divided, for example, into individual chambers that receive a contact system. In the illustrated embodiment, the contact system consists of a moveable spring contact 3 and a fixed spring contact 11. The moveable spring contact 3 can be deflected horizontally with respect to the fixed spring contact 11 between an open position and a closed position where the moveable spring contact 3 is in electrical contact with the fixed spring contact 11 in the closed position. The moveable spring contact 3 has at least one recess 22 formed therein. The electrical relay could also be configured with substantially more complex contact systems, such as the contact system described in DE 198 47 831 A1. For example, a further fixed spring contact could be provided such that a changeover electrical relay is produced.

A comb-like slider 2 is arranged parallel to the base plane 1. A first lug 21 extends from an end of the slider 2 adjacent the moveable spring contact 3. The first lug 21 is configured to be received in and guided by the recess 22 in the moveable spring contact 3. On a side of the slider 2 opposite from the first lug 22 is a second lug. The second lug is configured such that the second lug can rest on the moveable spring contact 3 without bearing during assembly of the slider 2 on the electrical relay. Proximate the second lug, the slider 2 is provided with a contact opening element 20 that extends substantially parallel to the slider 2. In the illustrated embodiment, the contact opening element 20 is shaped substantially as a downward extending hook that engages the moveable spring contact 3 from above. At an opposite end, the slider 2 has an armature projection receiving recess 12.

Figure 7:
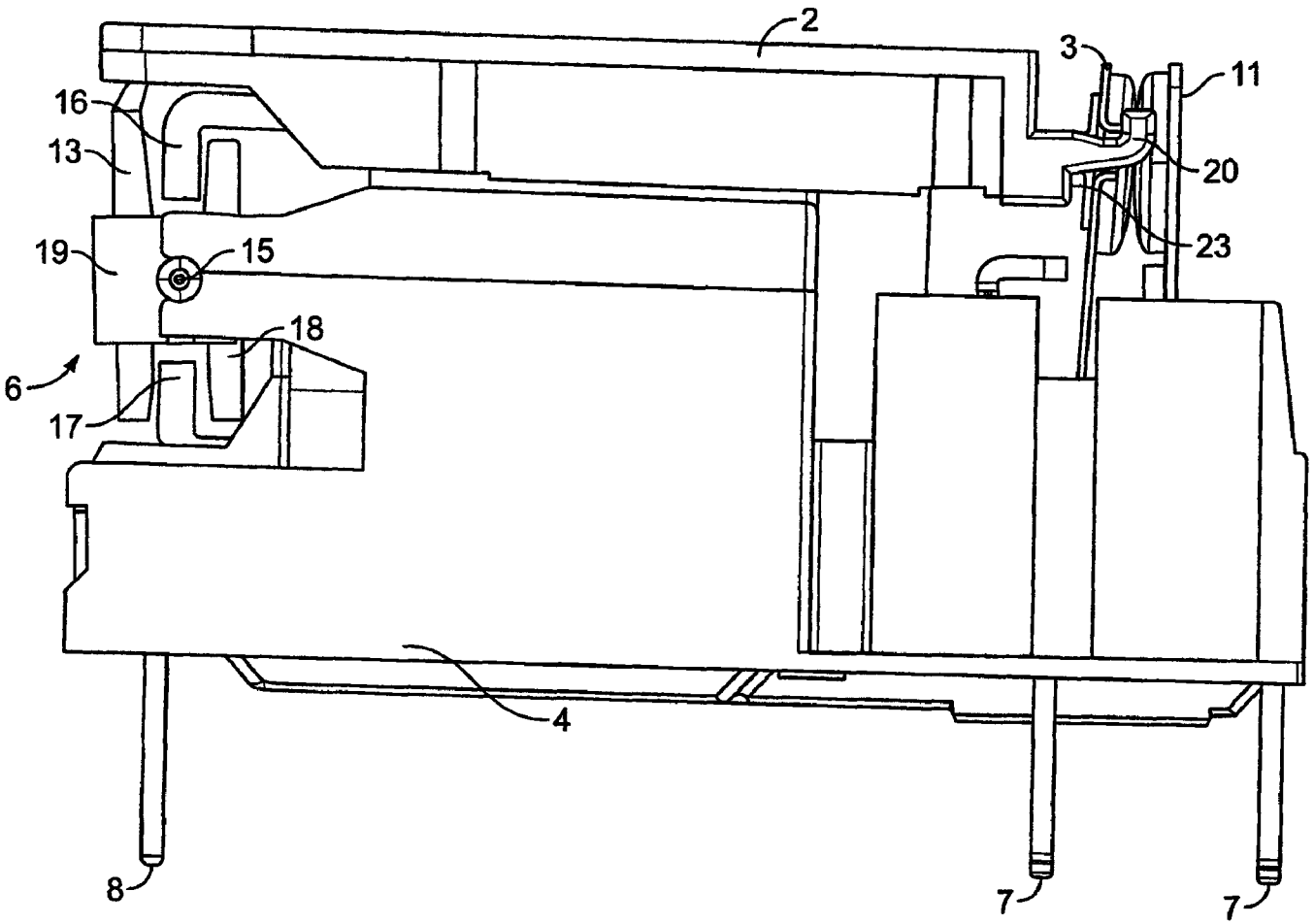
FIG. 7 is a schematic side view of the electrical relay of FIG. 3 showing the electrical relay in the operating stage in which the contact system of the electrical relay has been welded.

The substantially H-shaped armature 6 consists of substantially parallel armature plates 13, 18 separated by a permanent magnet located there between (FIG. 7). The substantially H-shaped armature 6 may be provided with a plastic material sheathing 19 in an approximate center thereof (FIG. 7). Axle bearings 15 may be integrally formed on both sides of the plastic material sheathing 19 (FIG. 7). The axle bearings 15 of the substantially H-shaped armature 6 are mounted on both sides at bearing points of the base 4, allowing the substantially H-shaped armature 6 to rotate about the bearing points. An armature projection 14 which is integral with the armature plate 13 has an armature projection 14 integrally formed therewith that engages the armature projection receiving recess 12 in the slide 2.

The armature plates 13, 18 extend beyond an air gap on sides of free ends of opposing yoke legs 16, 17 (FIG. 7). The rotational movement of the armature 6 is delimited when the armature plates 13, 18 strike the free ends of the yoke legs 16, 17. The substantially H-shaped armature 6 moves between a first switching position and a second switching position depending on the cooperation of the permanent magnet with pole faces of the yoke legs 16, 17, the polarity of which depends on the polarity of a coil. In the first switching position, the substantially H-shaped armature 6 corresponds to a first state of polarity of the coil and an upper end of the armature plate 18 strikes the yoke leg 16 and a lower end of the armature plate 13 strikes the yoke leg 17. In the second switching position, the substantially H-shaped armature 6 corresponds to a second state of polarity of the coil and an upper end of the armature plate 13 strikes the yoke leg 16 and a lower end of the armature plate 18 strikes the yoke leg 17.

The armature projection 14 moves back and forth substantially parallel to the base plane 1 as the armature plate 13 changes between the first and second switching positions. As the armature projection 14 moves back and forth substantially parallel to the base plane 1, the substantially horizontal movement of the armature projection 14 is transmitted to the slider 2 and, thereby, the moveable spring contact 3 to move the moveable spring contact 3 between the open and closed positions. In the magnetic system, the polarity can be reversed such that the substantially H-shaped armature 6 provides a force on the slider in the first and second switching directions and on the moveable spring contact 3 during movement to the open and closed positions. Once the magnetic system has changed over from the first switching position to the second switching position, the voltage on the coil can be terminated, because the first or second switching position is maintained by the permanent magnet until the coil is again magnetized in the opposite direction.

When the moveable spring contact 3 is brought into the open position, the slider 2 is drawn to the right in FIG. 2 by the armature 6. As the slider 2 is drawn to the right in FIG. 2, the contact opening element 20 that runs parallel to the slider 2 is pulled a short distance and then strikes the moveable spring contact 3. When the contact opening element 20 strikes the moveable spring contact 3, the contact opening element 20 applies a sudden and relatively intense pull on the moveable spring contact 3 that tears any existing weld between the moveable spring contact 3 and the fixed spring contact 11. If there is no weld, the restoring force of the moveable spring contact 3 causes the moveable spring contact 3 to move toward the right in FIG. 2, so the contact opening element 20 will normally not strike the moveable spring contact 3.

In the electrical relay, the weld is torn by the restoring energy of the slider 2 and the armature 6. In order to allow maximum possible tearing force or energy to be applied to the moveable spring contact 3, the distance between the contact opening element 20 and an end face of the moveable spring contact 3 that faces the fixed spring contact 11 has to be sufficiently great to enable the slider 2 to open almost fully, despite the weld, and only then to remain suspended from the moveable spring contact 3. As a result of this delayed action of the slider 2 on the welded moveable spring contact 3 during movement to the open position, the energy of the recoiling parts, or, in the case of the bistable electrical relay, the full opening force at the end of the armature tightening movement, can be fully utilized for tearing the weld.

As shown in FIG. 2, in order to assemble the slider 2 to the electrical relay, the slider 2 must be laterally unfolded. The slider 2 is guided and mounted in the recess 22 in the moveable spring contact 3 by the first lug 21. The second lug rests on the moveable spring contact 3 without bearing. Assembly of the electrical relay with upwardly directed electrical terminals 7, 8 could thus result in the slider 2 resting against the base 4, and this could, to a certain degree, result in abrasion which is undesirable from the point of view of the electrical service life of the electrical relay.

FIGS. 3-7 show an electrical relay according to a second embodiment of the present invention. Only the elements of the electrical relay according to the second embodiment that are different from the elements of the electrical relay according the first embodiment will be described in greater detail hereafter.

Figure 3:
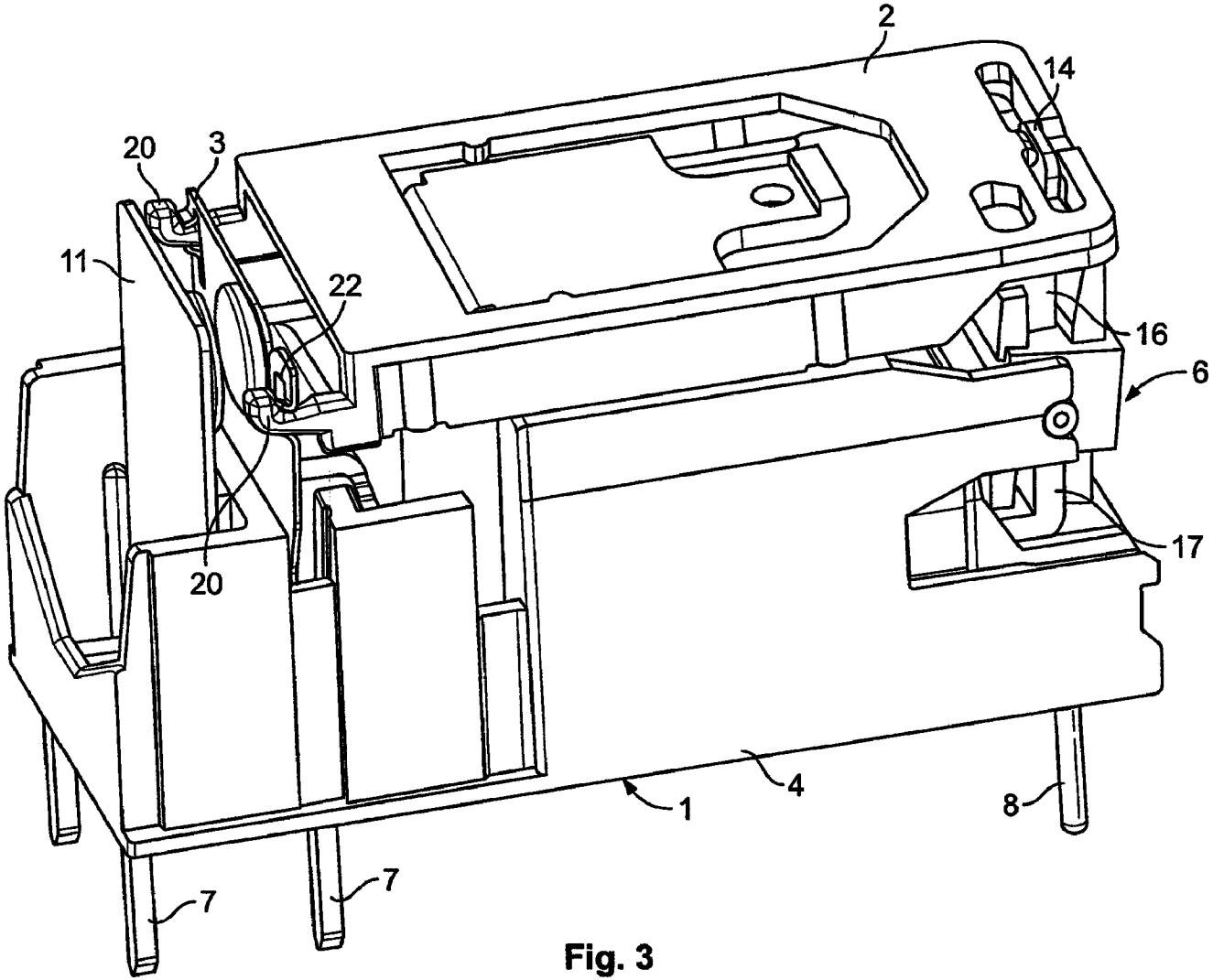
FIG. 3 is schematic perspective view of an electrical relay according to a second embodiment of the present invention.
Figure 4:
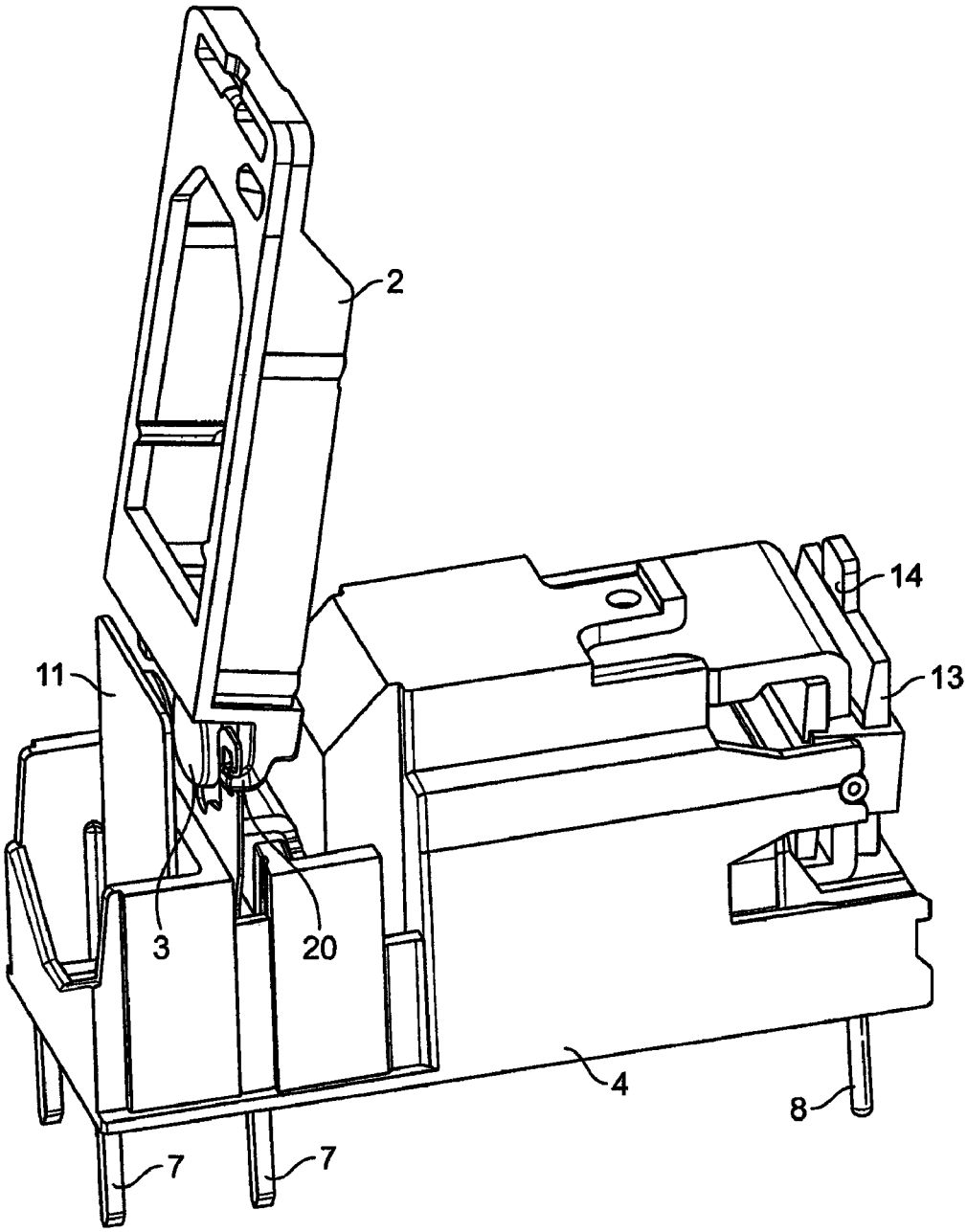
FIG. 4 is schematic perspective view of the electrical relay of FIG. 3 showing the electrical relay in an assembly position.
Figure 5:
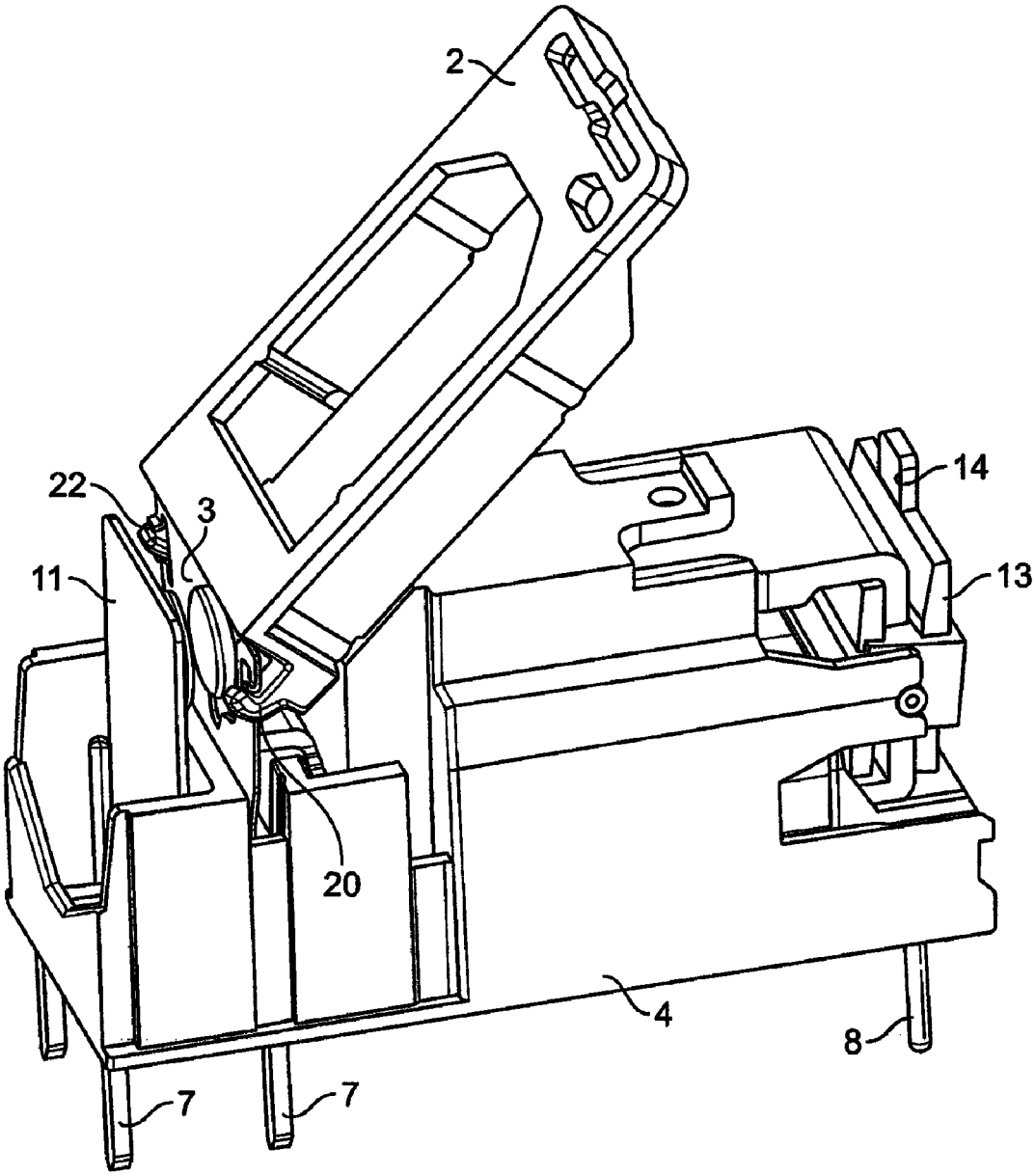
FIG. 5 is schematic perspective view of the electrical relay of FIG. 3 showing the electrical relay in an advanced assembly position.
Figure 6:
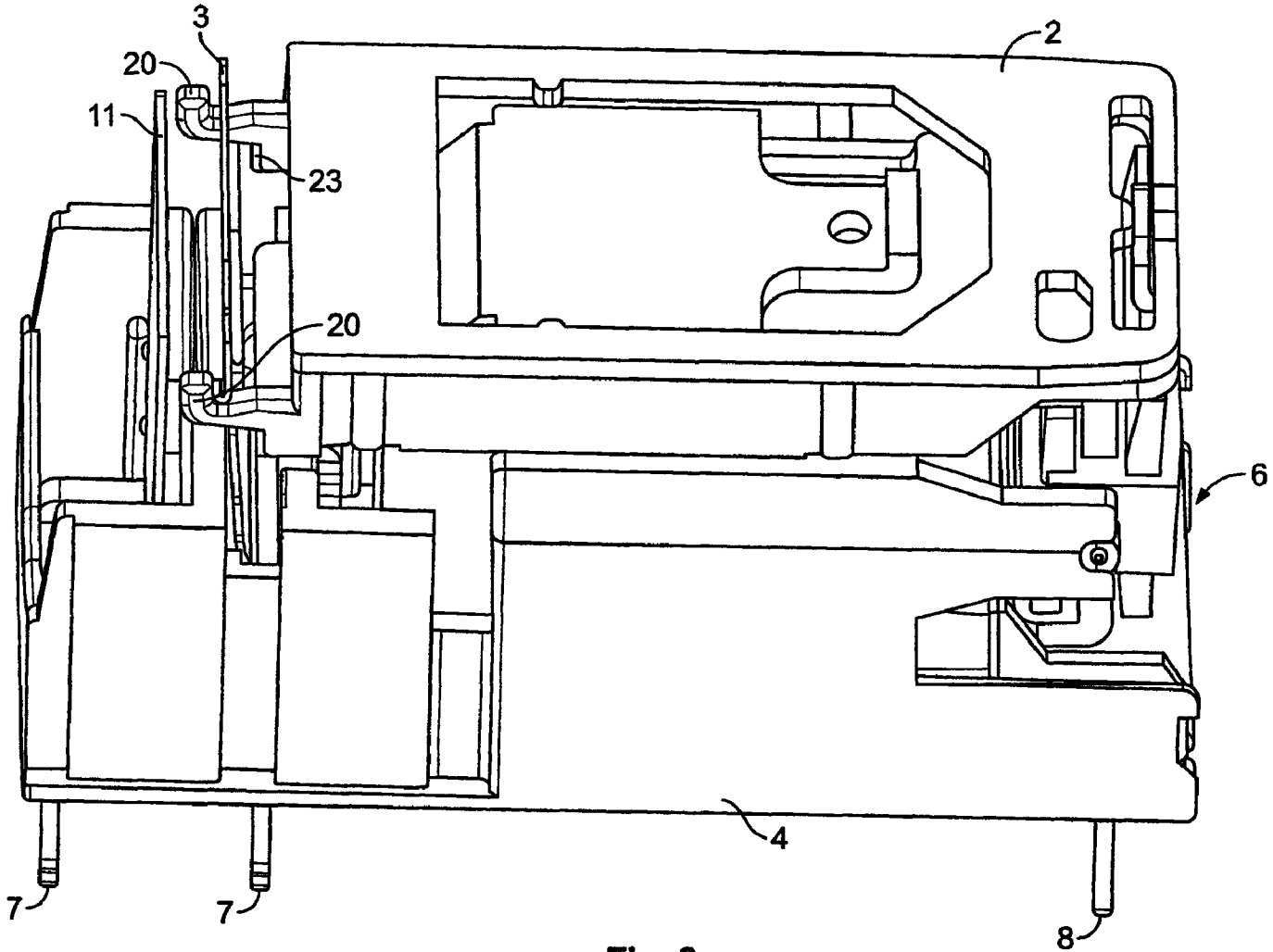
FIG. 6 is schematic perspective view of the electrical relay of FIG. 3 showing the electrical relay in an operating stage in which a contact system of the electrical relay has been welded.

As shown in FIG. 3, contact opening elements 20 extend from both edges of the slider 2. Each of the contact opening elements 20 has a shoulder 23, as shown in FIG. 6. The contact opening elements 20 are guided through recesses 22 in the moveable contact spring 3 and upwardly engage behind a face of the moveable spring contact 3 that faces the fixed spring contact 11. As shown in FIGS. 4-5, in order to attach the slider to the electrical relay, the slider 2 is erected about 90 degrees and is then folded downward such that the contact opening elements 20 rotate into the recesses 22 in the moveable spring contact 3.

As shown in FIGS. 6-7, in the bistable electrical relay, when the moveable spring contact 3 is brought into the open position, the slider 2 is drawn to the left in FIG. 7 by the armature 6. As the slider 2 is drawn to the left in FIG. 7, the contact opening elements 20 apply a sudden pull to the moveable spring contact 3 which is intended to undo any existing weld between the moveable spring contact 3 and the fixed spring contact 11. When the moveable spring contact 3 is brought into the closed position, the shoulders 23 of the contact opening elements 20 move the moveable spring contact 3 toward the fixed spring contact 11. Additionally, in a monostable electrical relay, the slider 2 travels toward the left in FIG. 7 by means of an armature spring and the mass of the slider 2 and the armature 6. Just before the moveable spring contact 3 returns to the open position, the contact opening elements 20 apply a sudden pull to the moveable spring contact 3 which is intended to undo the weld.

FIGS. 8-12 show an electrical relay according to a third embodiment of the present invention. Only the elements of the electrical relay according to the third embodiment that are different from the elements of the electrical relay according the first embodiment will be described in greater detail hereafter.

Figure 8:
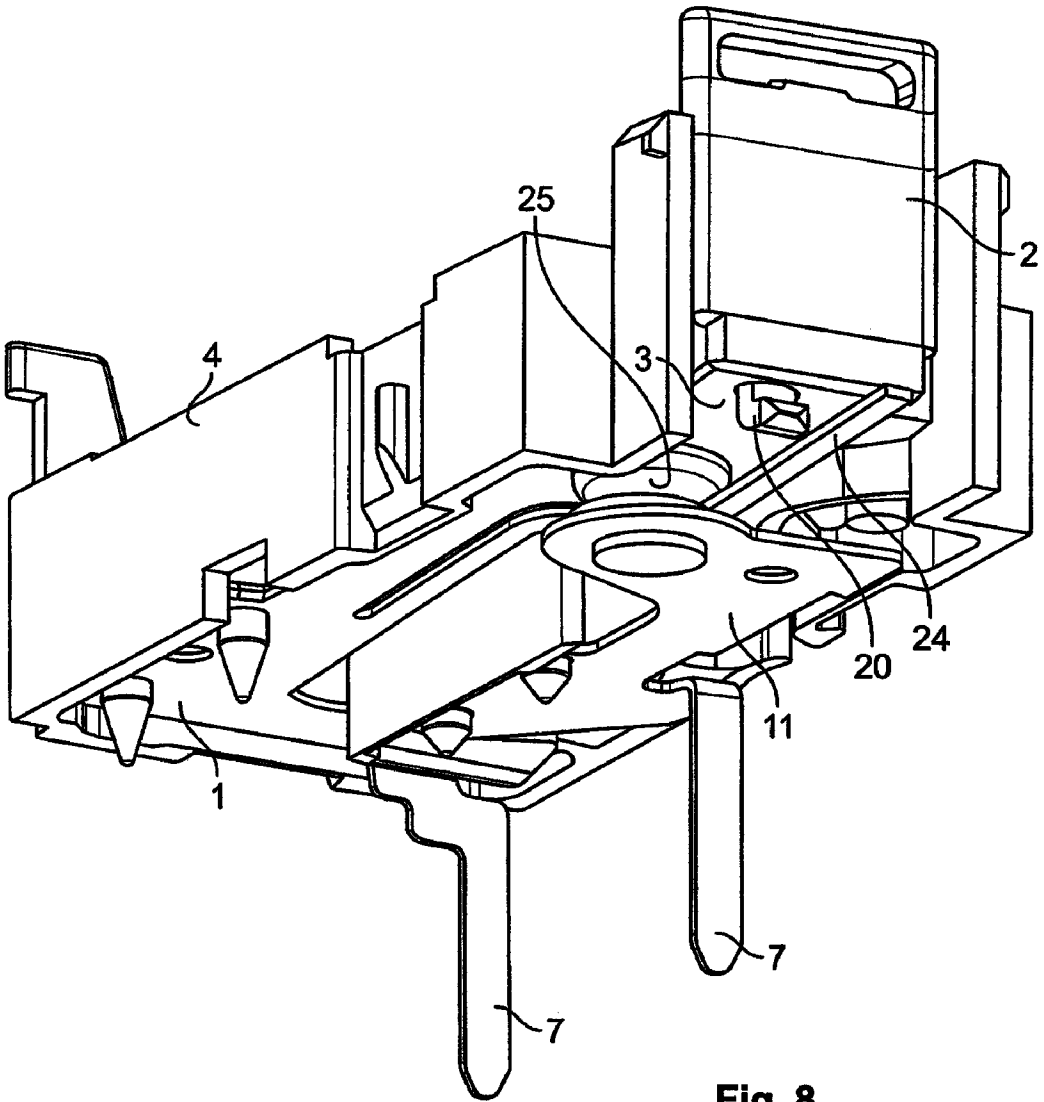
FIG. 8 is schematic perspective view of an electrical relay according to a third embodiment of the present invention.
Figure 9:
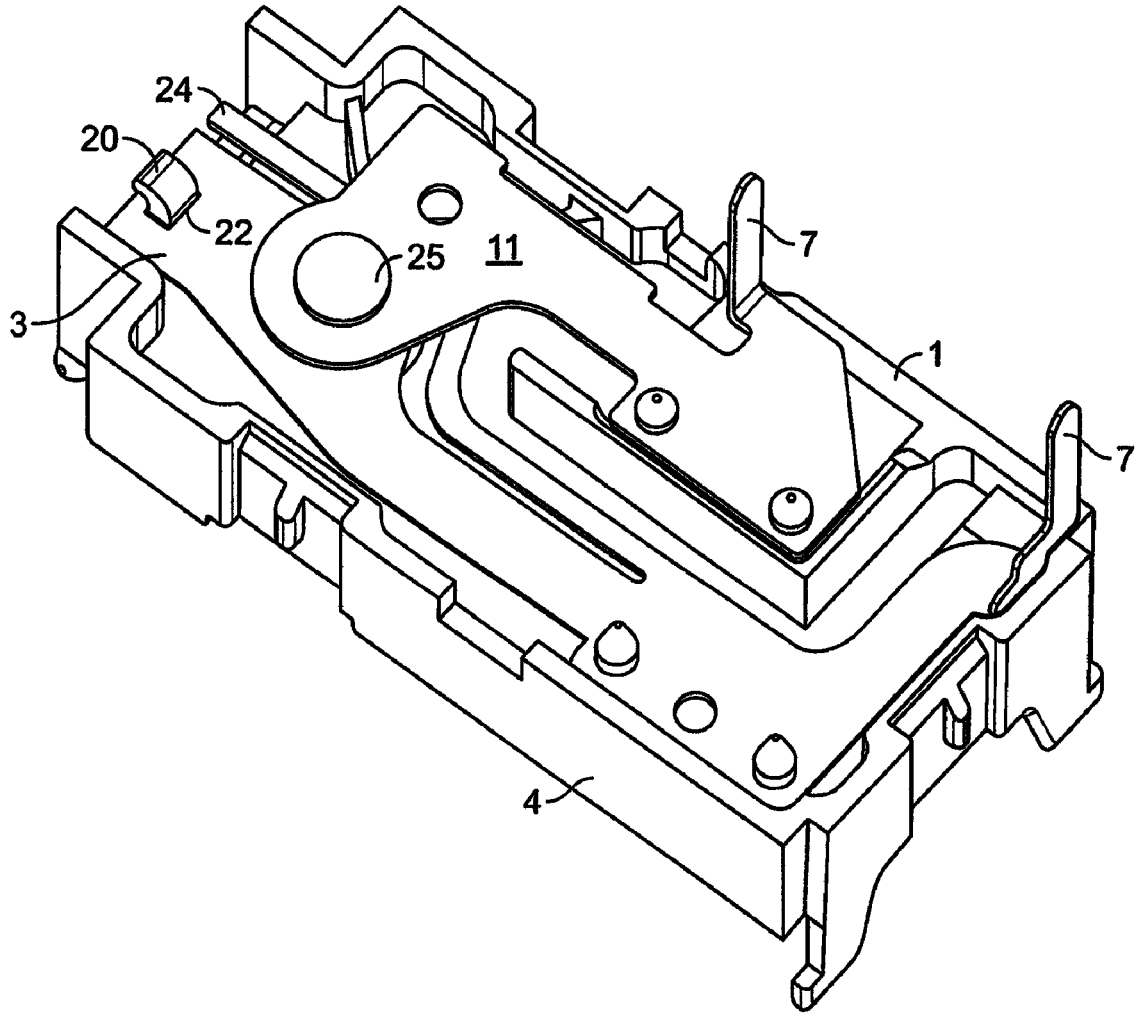
FIG. 9 is schematic perspective view of the electrical relay of FIG. 8.
Figure 10:
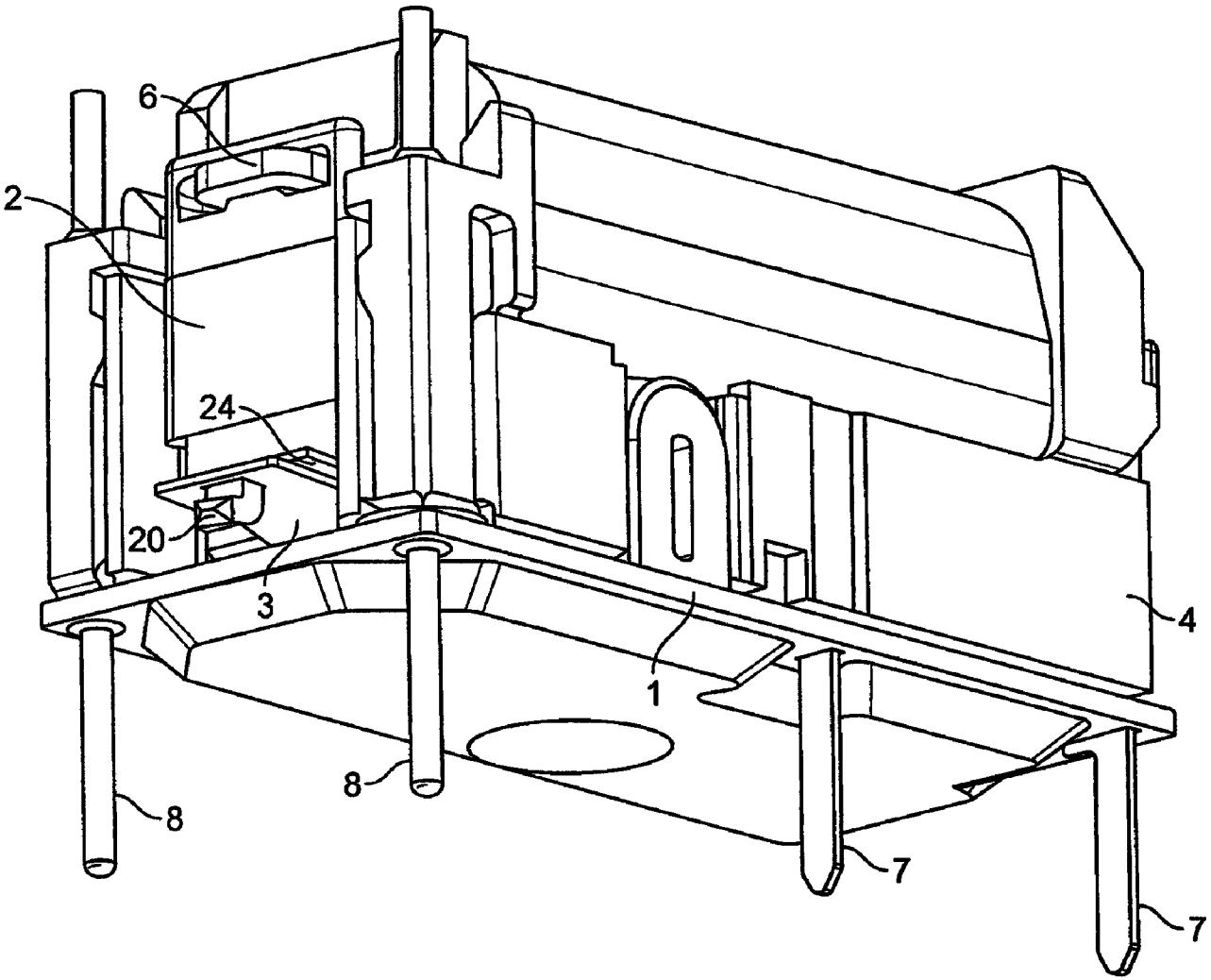
FIG. 10 is schematic perspective view of the electrical relay of FIG. 8.
Figure 11:
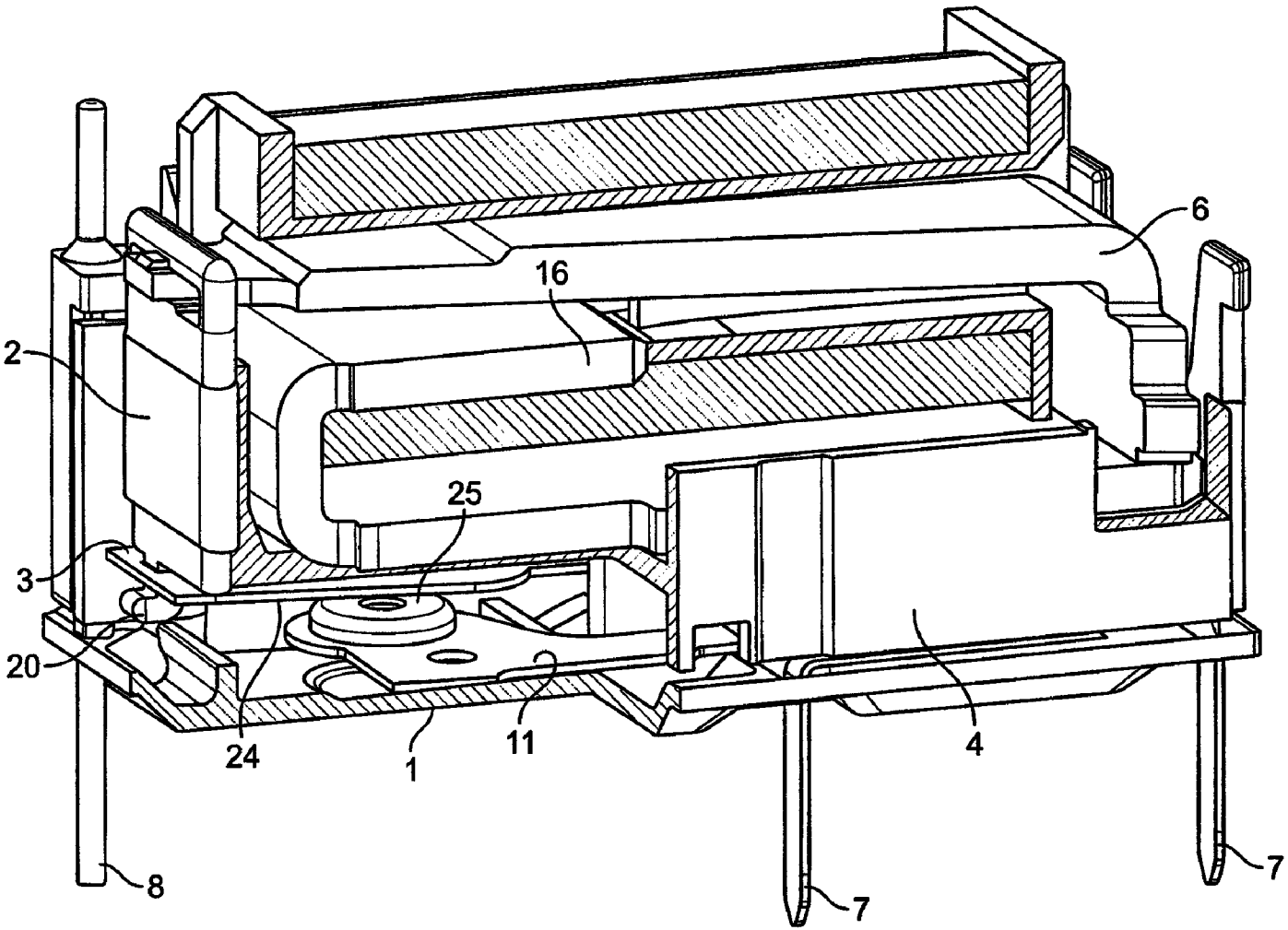
FIG. 11 is schematic partially sectional perspective view of the electrical relay of FIG. 8.
Figure 12:
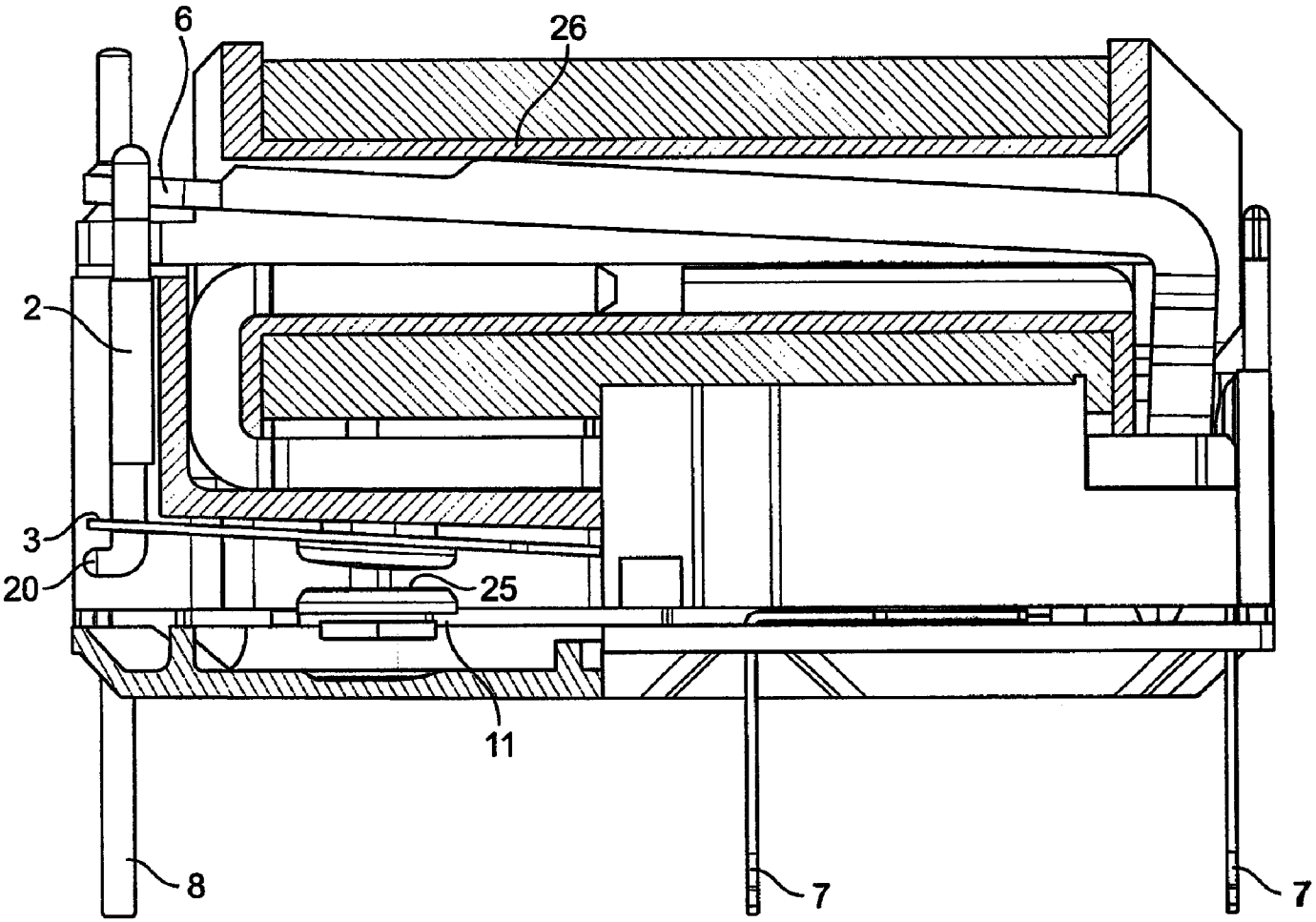
FIG. 12 is schematic partially sectional side view of the electrical relay of FIG. 8.

As shown in FIG. 11, the moveable spring contact 3 and the fixed spring contact 11 are arranged in the base 4 and have a welded contact zone 25. The moveable spring contact 3 and the fixed spring contact 11 extend substantially parallel to the base plane 1. The slider 2 is arranged substantially perpendicular to the base plane 1 and is moveable substantially perpendicular thereto. At a lower end of the slider 2 facing the moveable spring contact 3, the slider 2 has a contact opening element 20. The contact opening element 20 is guided through a recess 22 located in a free end of the moveable spring contact 3. The contact opening element 20 engages behind a side of the moveable spring contact 3 that faces the fixed spring contact 11. The free end of the moveable spring contact 3 has an arm 24, as shown in FIG. 8. The arm 24 is arranged such that the arm 24 is prevented from also being welded when the moveable spring contact 3 and the fixed spring contact 11 are welded in a region of the contact zone 25.

The slider 2 and the contact opening element 20 in the electrical relay according to the third embodiment operates in substantially the same manner as the contact opening element according to the electrical relay of the first embodiment. When moveable spring contact 3 is moved to the open position, the slider 2 is moved upward and the restoring force of the moveable spring contact 3 causes the moveable spring contact 3 to also automatically move upward, so that the contact between the fixed contact element 11 and the moveable contact element 3 is cancelled without the aid of the contact opening element 20. However, if the moveable spring contact 3 and the fixed spring contact 11 are welded in the region of the contact zone 25, initially merely the slider 2 moves upward on account of the arm 24. The distance between the portion of the contact opening element 20 that extends substantially parallel to an underside of the moveable spring contact 3 and the underside itself decreasing continuously until the contact opening element 20 finally strikes the moveable spring contact 3 and the weld is torn by the movement of the slider 2.

In the electrical relay of the third embodiment, the armature 6 does not have an armature return spring. The functioning of the armature return spring is replaced by the restoring force of the arm 24, which automatically presses the slider 2 upward when the magnetic system is unexcited regardless of whether or not the moveable spring contact 3 and the fixed spring contact 11 are welded so the slider 2 presses the armature 6 back into its bearing position via a pivot point 26.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electrical relay, comprising:

a magnetic system including an armature;

a contact system including a moveable spring contact and a fixed spring contact, the moveable spring contact being moveable between an open position and a closed position, the moveable spring contact being in electrical contact with the fixed spring contact in the closed position; and a slider connecting the moveable spring contact to the armature, the slider transferring movement of the armature to the moveable spring contact, the slider having at least one contact opening element extending there from, the contact opening element striking the moveable spring contact during movement of the moveable spring contact to the open position to break any existing weld between the moveable spring contact and the fixed spring contact;

wherein at least one of the contact opening elements extends toward the fixed spring contact and wrappingly engages an end face of the moveable spring contact that faces the fixed spring contact, the contact opening element strikes the moveable spring contact after being pulled a distance by the slider.

2. The electrical relay of claim 1, wherein the electrical relay is monostable.

3. The electrical relay of claim 1, wherein the electrical relay is bistable.

4. The electrical relay of claim 1, wherein the contact opening element is shaped substantially as a hook.

5. The electrical relay of claim 1, wherein the contact opening is received in and guided by a recess in the moveable spring contact.

6. The electrical relay of claim 1, wherein the slider is moveable substantially parallel to a base plane of a base of the electrical relay and the moveable spring contact and the fixed spring contact extend substantially perpendicular to the base plane of the base of the electrical relay.

7. The electrical relay of claim 1, wherein the moveable spring contact is arranged between the fixed spring contact and the slider.

8. The electrical relay of claim 1, wherein the contact opening element includes a shoulder that engages the moveable spring contact during movement of the moveable spring contact to the closed position.

9. The electrical relay of claim 1, wherein the armature includes an armature projection that engages in an armature projection receiving recess formed in the slider.

10. The electrical relay of claim 1, wherein the armature pivots between a first switching position and a second switching position.

11. The electrical relay of claim 1, wherein the armature includes armature plates separated by a permanent magnet.

12. The electrical relay of claim 1, wherein the contact opening element strikes the moveable spring contact immediately before the moveable spring contact reaches the open position.

13. The electrical relay of claim 1, wherein the contact opening element is shaped substantially as a hook.

14. An electrical relay, comprising:

a magnetic system including an armature;

a contact system including a moveable spring contact and a fixed spring contact, the moveable spring contact being moveable between an open position and a closed position, the moveable spring contact being in electrical contact with the fixed spring contact in the closed position; and a slider connecting the moveable spring contact to the armature, the slider transferring movement of the armature to the moveable spring contact, the slider having at least one contact opening element extending therefrom, the contact opening element striking the moveable spring contact during movement of the moveable spring contact to the open position to break any existing weld between the moveable spring contact and the fixed spring contact;

wherein at least one of the contact opening elements extends toward the fixed spring contact and wrappingly engages an end face of the moveable spring contact that faces the fixed spring contact, the contact opening element strikes the moveable spring contact just before the slider is fully opened.

* * * * *